US010919718B2

(12) United States Patent
Yaginuma et al.

(10) Patent No.: US 10,919,718 B2
(45) Date of Patent: Feb. 16, 2021

(54) MEDIUM SUPPLY APPARATUS AND IMAGE FORMING APPARATUS

(71) Applicant: FUJI XEROX CO., LTD., Tokyo (JP)

(72) Inventors: Shinji Yaginuma, Kanagawa (JP); Ryosuke Saika, Kanagawa (JP); Takuya Mori, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 56 days.

(21) Appl. No.: 16/294,955

(22) Filed: Mar. 7, 2019

(65) Prior Publication Data

US 2020/0079605 A1 Mar. 12, 2020

(30) Foreign Application Priority Data

Sep. 12, 2018 (JP) ..... 2018-170325

(51) Int. Cl.
*B65H 1/12* (2006.01)
*B65H 1/26* (2006.01)

(52) U.S. Cl.
CPC ..... *B65H 1/12* (2013.01); *B65H 1/266* (2013.01); *B65H 2405/114* (2013.01);
(Continued)

(58) Field of Classification Search
CPC ..... B65H 2405/324; B65H 2405/31; B65H 1/12; B65H 1/266; B65H 2405/1117; B65H 2405/114; B65H 2405/35; B65H 2405/354
See application file for complete search history.

(56) References Cited

U.S. PATENT DOCUMENTS 7,568,692 B2 8/2009 Miyake
8,910,933 B2 * 12/2014 Shin ..... B65H 1/12 271/157

(Continued)

FOREIGN PATENT DOCUMENTS

JP 2006327706 12/2006
JP 2008133061 6/2008

*Primary Examiner* — Jeremy R Severson
(74) *Attorney, Agent, or Firm* — JCIPRNET

(57) ABSTRACT

A medium supply apparatus includes a box member, a bottom plate, and a rotary portion. A medium is stored inside the box member. The box member is inserted into and extracted from a body of an image forming apparatus. The bottom plate is disposed at a bottom portion of the box member. The medium is placed on the bottom plate. The bottom plate is lifted up by an elastic force of an elastic member. The rotary portion is attached to a side wall, among walls of the box member, positioned on a lateral side with respect to a front side toward which the box member is extracted from the image forming apparatus. The rotary portion is rotatable about a location of attachment of the rotary portion. The rotary portion includes a rear portion and a front portion. The rear portion is positioned on a rear side, in contrast to the front side, with respect to the location of attachment. The rear portion is moved upward by a reaction force applied from the body when the box member is extracted. The front portion is positioned on the front side with respect to the location of attachment. The front portion is moved downward by rotation of the rotary portion due to upward movement of the rear portion to lower the bottom plate against the elastic force.

14 Claims, 9 Drawing Sheets

(52) U.S. Cl.
CPC ..... *B65H 2405/1117* (2013.01); *B65H 2405/324* (2013.01); *B65H 2405/354* (2013.01)

(56) References Cited

U.S. PATENT DOCUMENTS

| | | | | |
|---|---|---|---|---|
| 10,065,818 | B1 * | 9/2018 | Nishimura | B65H 3/0607 |
| 2006/0157917 | A1 * | 7/2006 | Kim | B65H 1/12 271/147 |

* cited by examiner

MEDIUM SUPPLY APPARATUS AND IMAGE FORMING APPARATUS

CROSS-REFERENCE TO RELATED APPLICATIONS

This application is based on and claims priority under 35 USC 119 from Japanese Patent Application No. 2018-170325 filed Sep. 12, 2018.

BACKGROUND

(i) Technical Field

The present disclosure relates to a medium supply apparatus and an image forming apparatus.

(ii) Related Art

There has hitherto been known a medium supply apparatus that is inserted into and drawn out of an image forming apparatus to supply a recording medium stored inside the medium supply apparatus to the image forming apparatus.

Japanese Unexamined Patent Application Publication No. 2006-327706, for example, discloses a paper feed device that includes a lift mechanism that lifts up the opening portion side of paper placed in a paper feed cassette inserted into an opening portion to press the paper against a pickup roller on the printer body side.

Meanwhile, Japanese Unexamined Patent Application Publication No. 2008-133061, for example, discloses a paper supply device that includes a lift plate which is disposed in a paper feed cassette that is drawable from a printer body and on the upper surface of which paper is placed, and a depressing mechanism that depresses the lift plate to the vicinity of the inner bottom surface of the paper feed cassette when the paper feed cassette is drawn out.

SUMMARY

Aspects of non-limiting embodiments of the present disclosure relate to reducing a force required to draw out a medium supply apparatus compared to a case where a rotary portion is not provided.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a medium supply apparatus including: a box member inside which a medium is stored and which is inserted into and extracted from a body of an image forming apparatus; a bottom plate which is disposed at a bottom portion of the box member and on which the medium is placed, the bottom plate being lifted up by an elastic force of an elastic member; and a rotary portion attached to a side wall, among walls of the box member, positioned on a lateral side with respect to a front side toward which the box member is extracted from the image forming apparatus, the rotary portion being rotatable about a location of attachment of the rotary portion, in which the rotary portion includes a rear portion positioned on a rear side, in contrast to the front side, with respect to the location of attachment, the rear portion being moved upward by a reaction force applied from the body when the box member is extracted, and a front portion positioned on the front side with respect to the location of attachment, the front portion being moved downward by rotation of the rotary portion due to upward movement of the rear portion to lower the bottom plate against the elastic force.

BRIEF DESCRIPTION OF THE DRAWINGS

An exemplary embodiment of the present disclosure will be described in detail based on the following figures, wherein.

DETAILED DESCRIPTION

An exemplary embodiment of the present disclosure will be described below with reference to the drawings.

Figure 1:
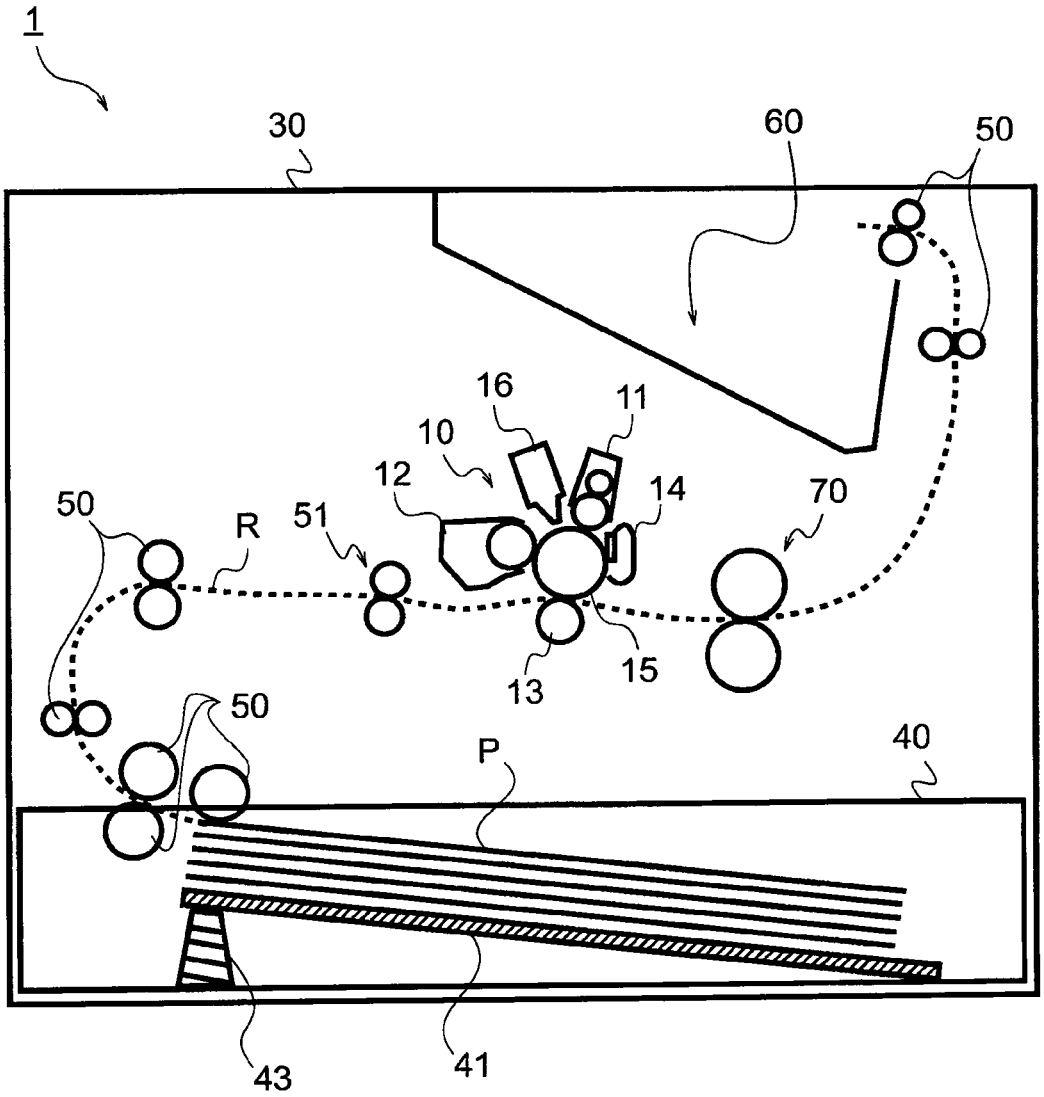
FIG. 1 illustrates a schematic configuration of a printer corresponding to an image forming apparatus according to an exemplary embodiment.

FIG. 1 illustrates a schematic configuration of a printer corresponding to an image forming apparatus according to an exemplary embodiment.

A printer 1 is a so-called monochrome printer, and includes one image engine 10. By way of example, the image engine 10 forms a toner image using an electrophotographic system, and is structured such that a charging unit 11, an exposure unit 16, a developing unit 12, a transfer unit 13, and a cleaner 14 are arranged in this order around a photoconductor 15 in a columnar shape.

In the image engine 10, the photoconductor 15 is sequentially subjected to charging executed by the charging unit 11, light exposure executed by the exposure unit 16, and development executed by the developing unit 12 so that a toner image is formed on the photoconductor 15.

A paper feed tray 40 that stores stacked sheets of paper P that serves as a type of a recording material is provided in the lower part of the printer 1. The paper feed tray 40 corresponds to an example of a medium supply apparatus according to the present disclosure. The paper P in the paper feed tray 40 is placed on a bottom plate 41, which is pushed up by a push spring 43. Consequently, the paper P is lifted up to a position at which the paper P may be taken out of the paper feed tray 40. An elastic member that raises the bottom plate 41 may be rubber or the like.

The paper P is taken out of the paper feed tray 40 by transport rollers 50, and fed upward along a transport path R. After that, the paper P is fed to resist rollers 51 by the transport rollers 50. The resist rollers 51 feed the paper P to the image engine 10. The timing when the paper P is fed to the image engine 10 matches the timing when a toner image is formed on the photoconductor 15. The toner image on the photoconductor 15 is transferred onto the paper P by the transfer unit 13. The cleaner 14 removes a toner, paper powder, etc. that remains on the photoconductor 15 after the transfer.

The paper P to which the image has been transferred is further transported on the transport path R to be fed to a fixing unit 70. The fixing unit 70 applies heat and a pressure to the paper to fix the image on the paper to the paper.

The paper P to which the image has been fixed is further transported upward along the transport path R, and fed out of a housing 30 of the printer 1 by the transport rollers 50. The paper P which has been fed out of the housing 30 is placed on a paper output tray 60 formed on the upper surface of the housing 30.

The paper feed tray 40 is structured to be inserted into and extracted from the housing 30 of the printer 1 for replenishment of the paper P.

Figure 2:
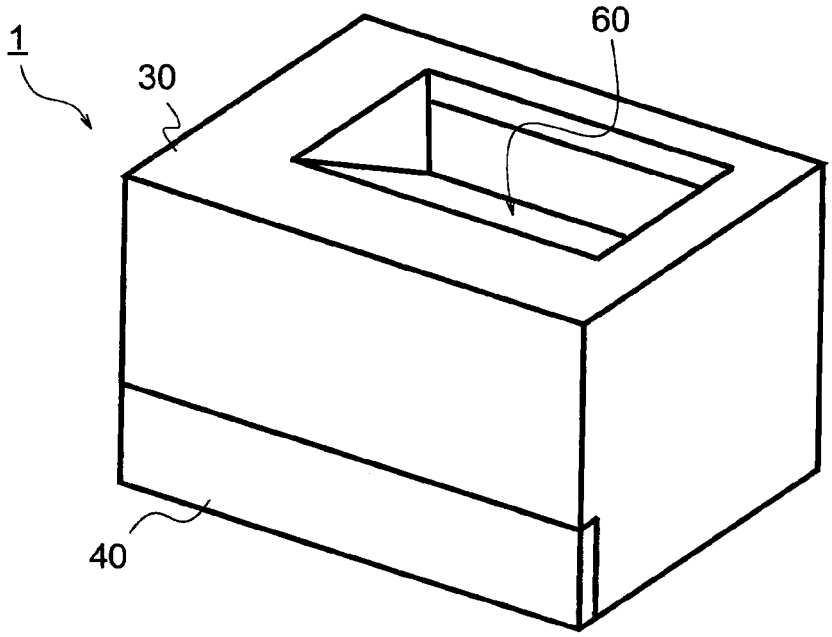
FIG. 2 illustrates a state in which a paper feed tray is inserted into the printer.
Figure 3:
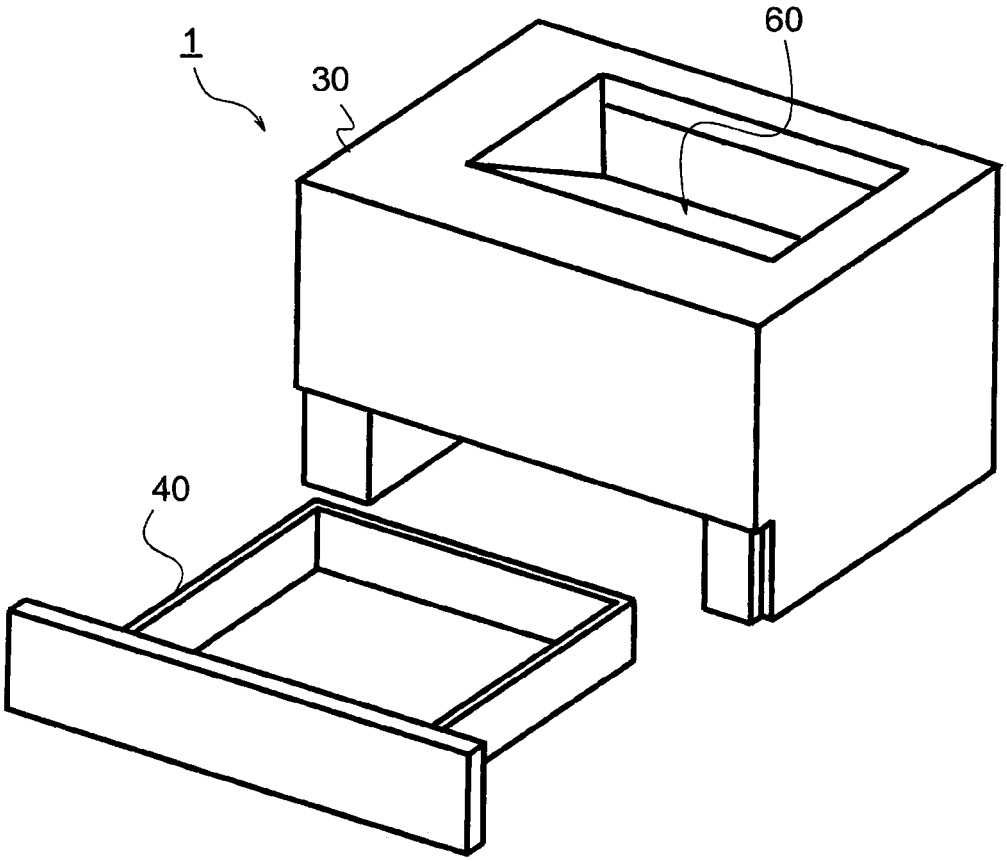
FIG. 3 illustrates a state in which the paper feed tray is drawn out of the printer.

FIGS. 2 and 3 illustrate a state in which the paper feed tray 40 is inserted into and extracted from the printer 1. FIG. 2 illustrates a state in which the paper feed tray 40 is inserted into the printer 1. FIG. 3 illustrates a state in which the paper feed tray 40 is drawn out of the printer 1.

The paper output tray 60 discussed above is formed on the upper surface of the housing 30 of the printer 1. The front surface of the printer 1, which corresponds to the left side in FIG. 1, is illustrated on the front side of FIGS. 2 and 3. The paper feed tray 40 is inserted into and drawn out of the printer 1 on the front surface side.

In the case where the paper feed tray 40 is inserted into the printer 1 as illustrated in FIG. 2, the paper P in the paper feed tray 40 is lifted up by the bottom plate 41 and the push spring 43 as illustrated in FIG. 1. When the paper feed tray 40 is drawn out of the printer 1 as illustrated in FIG. 3, however, the bottom plate 41 is lowered so that the paper feed tray 40 may be replenished with the paper P.

Figure 4:
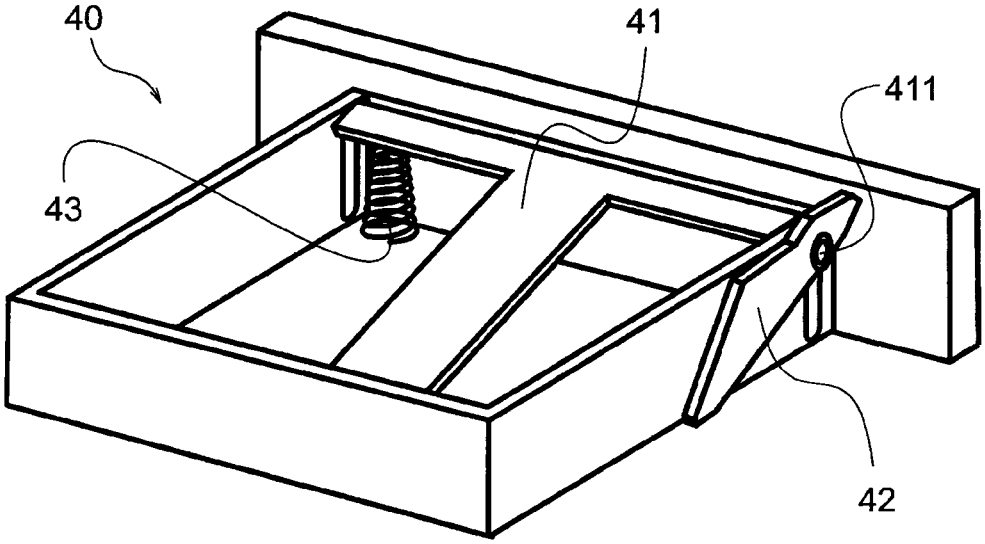
FIG. 4 illustrates a state in which a bottom plate is lifted up.
Figure 5:
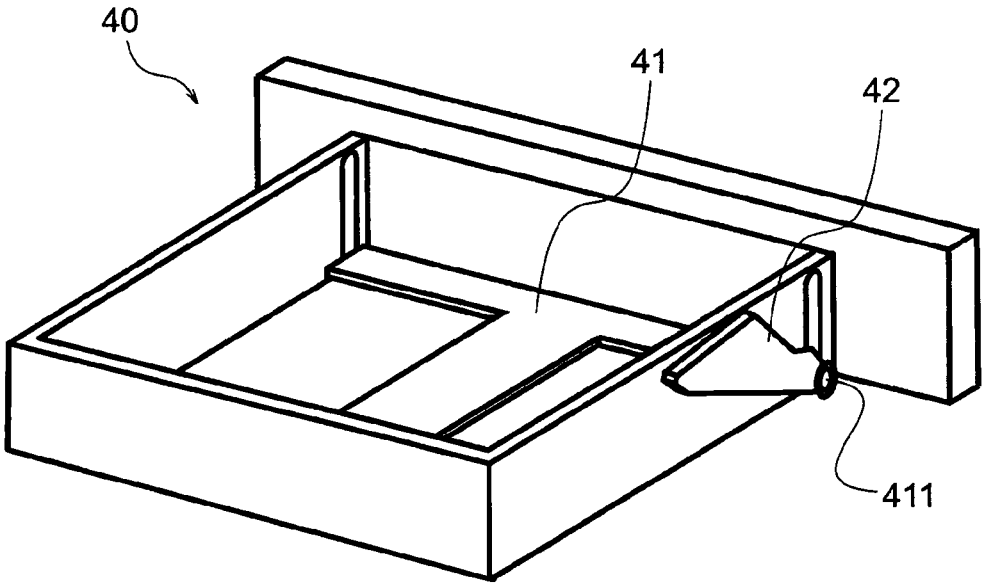
FIG. 5 illustrates a state in which the bottom plate is lowered.

FIGS. 4 and 5 illustrate how the bottom plate 41 is raised and lowered. FIG. 4 illustrates a state in which the bottom plate 41 is raised. FIG. 5 illustrates a state in which the bottom plate 41 is lowered.

FIGS. 4 and 5 illustrate the paper feed tray 40 with the rear side of the paper feed tray 40 directed toward the front side of the drawings. In the case where the paper feed tray 40 is inserted into the printer 1 as illustrated in FIG. 2, the bottom plate 41 is pushed up by an elastic force of the push spring 43 as illustrated in FIG. 4. In the present exemplary embodiment, the paper is drawn out from the front side of the paper feed tray 40, and thus the bottom plate 41 is lifted up on the front side of the paper feed tray 40.

When the paper feed tray 40 is drawn out of the printer 1 as illustrated in FIG. 3, the bottom plate 41 is lowered as illustrated in FIG. 5. Such lowering of the bottom plate 41 is achieved by an operation force applied when the paper feed tray 40 is drawn out of the printer 1. One end of a shaft 411 connected to the front end of the bottom plate 41 projects from a side surface of the paper feed tray 40. A link mechanism 42 that operates in conjunction with the shaft 411 is provided on the side surface of the paper feed tray 40. The link mechanism 42 converts the operation force which is applied when the paper feed tray 40 is drawn out of the printer 1 into a depression force that depresses the shaft 411. The link mechanism 42 corresponds to an example of a rotary portion according to the present disclosure.

The link mechanism 42 will be described in detail below.

Figure 6:
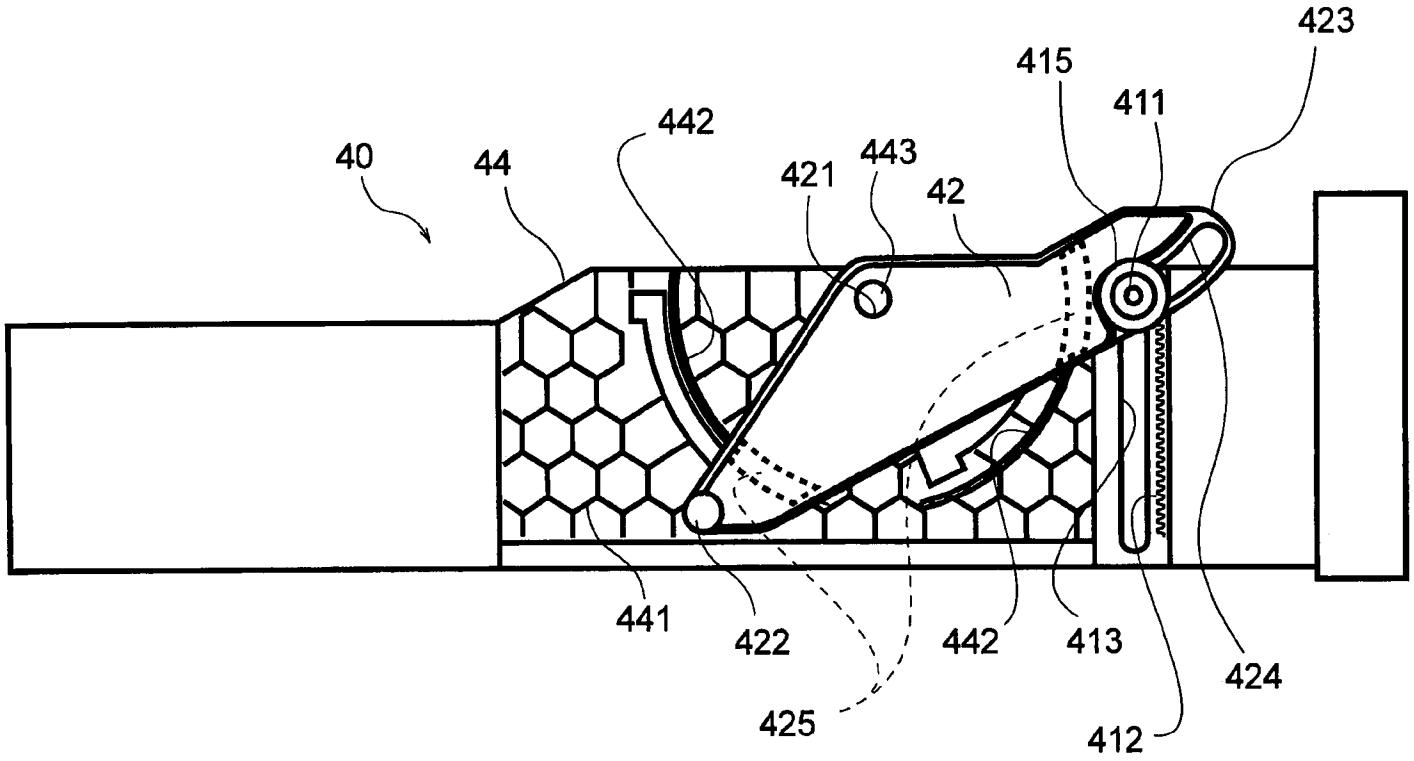
FIG. 6 illustrates a state of a link mechanism at the time when the bottom plate is raised.
Figure 7:
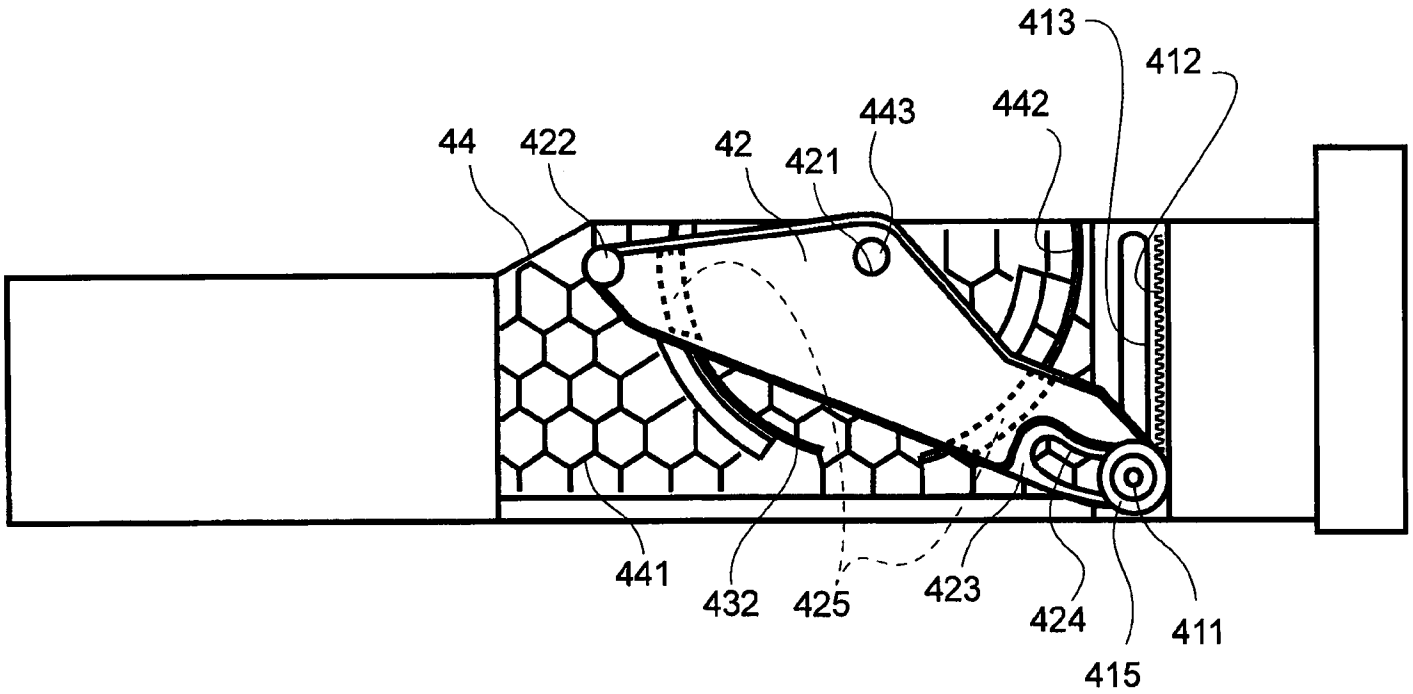
FIG. 7 illustrates a state of the link mechanism at the time when the bottom plate is lowered.

FIGS. 6 and 7 illustrate the details of the link mechanism 42.

FIG. 6 illustrates a state of the link mechanism 42 in which the bottom plate 41 is raised. FIG. 7 illustrates a state of the link mechanism 42 in which the bottom plate 41 is lowered. The right side of FIGS. 6 and 7 corresponds to the front side of the paper feed tray 40. The left side of FIGS. 6 and 7 corresponds to the rear side of the paper feed tray 40.

The link mechanism 42 is a member that is rotatable with respect to a side wall 44 of the paper feed tray 40. A rotary shaft 443 that projects from the side wall 44 penetrates a round hole 421 of the link mechanism 42 to be fitted. The link mechanism 42 is supported by the rotary shaft 443, and is rotatable about the rotary shaft 443. The rotary shaft 443 and the round hole 421 correspond to an example of a location of attachment according to the present disclosure. The location of attachment according to the present disclosure may be configured such that the side wall 44 is provided with a round hole 421 and a rotary shaft 443 that projects from the link mechanism 42 is fitted with the round hole 421.

A projecting portion 422 that projects toward the front side in the drawings is provided on the rear side of the link mechanism 42. As discussed later, a force for drawing out the paper feed tray 40 is applied to the projecting portion 422 to rotate the link mechanism 42. The projecting portion 422 corresponds to an example of a rear portion according to the present disclosure.

A coupling portion 423 coupled to the shaft 411 via a rotary member 415 attached to an end portion of the shaft 411 is provided on the front side of the link mechanism 42. A curved long hole 424 is formed in the coupling portion 423. The rotary member 415 plays a role as a slip-off stopper that suppresses slipping of the shaft 411 from the long hole 424. The coupling portion 423 corresponds to an example of a front portion according to the present disclosure.

The shaft 411 penetrates a straight slit 413 formed in the side wall 44 to be connected to the bottom plate 41. The shaft 411 is moved up and down along the slit 413 in conjunction with the bottom plate 41. In the case where the link mechanism 42 is rotated, the shaft 411 is moved relative to the coupling portion 423 such that the rotary member 415 rolls on the upper edge of the long hole 424 of the coupling portion 423.

The upper edge of the long hole 424 is formed so as to be directed vertically downward at the position of contact with the rotary member 415 no matter what direction the link mechanism 42 is rotated in.

When the projecting portion 422 is raised from the state illustrated in FIG. 6 to the state illustrated in FIG. 7, the coupling portion 423 is lowered with the link mechanism 42 rotated about the rotary shaft 443. As a result, the shaft 411 is depressed by the coupling portion 423, and the bottom plate 41 is also depressed.

A pinion gear (not illustrated) is fixed to the shaft 411. The teeth of the pinion gear are meshed with a rack gear 412 provided on the side wall 44. Such a pinion gear and a rack gear are also provided at the other end of the shaft 411, in contrast to one end illustrated in the drawings, and such gear mechanisms operate in conjunction with each other to allow the shaft 411 and the front end of the bottom plate 41 to be moved up and down horizontally.

Since the gear mechanisms which allow the shaft 411 to be moved up and down horizontally are provided in this manner, the link mechanism 42 is provided only on the side illustrated in FIGS. 6 and 7, of the two side surfaces of the paper feed tray 40.

Planar portions 425 to be in friction with the side wall 44 side are formed on the back surface side of the link mechanism 42, that is, the side of the link mechanism 42 which faces the side wall 44. Contact ribs 442 are formed on the side wall 44. The side wall 44 and the link mechanism 42 contact each other on the contact ribs 442. The contact ribs 442 correspond to an example of a protrusion according to the present disclosure.

The side wall 44 is also provided with hexagonal reinforcing ribs 441 that increase the strength of the side wall 44 against deflection.

Next, a mechanism that transfers a force for drawing out the paper feed tray 40 to the link mechanism 42 will be described.

The body of the printer 1 into which the paper feed tray 40 is inserted is provided with a rail that lifts up the projecting portion 422 of the link mechanism 42 using the force for drawing out the paper feed tray 40.

Figure 8:
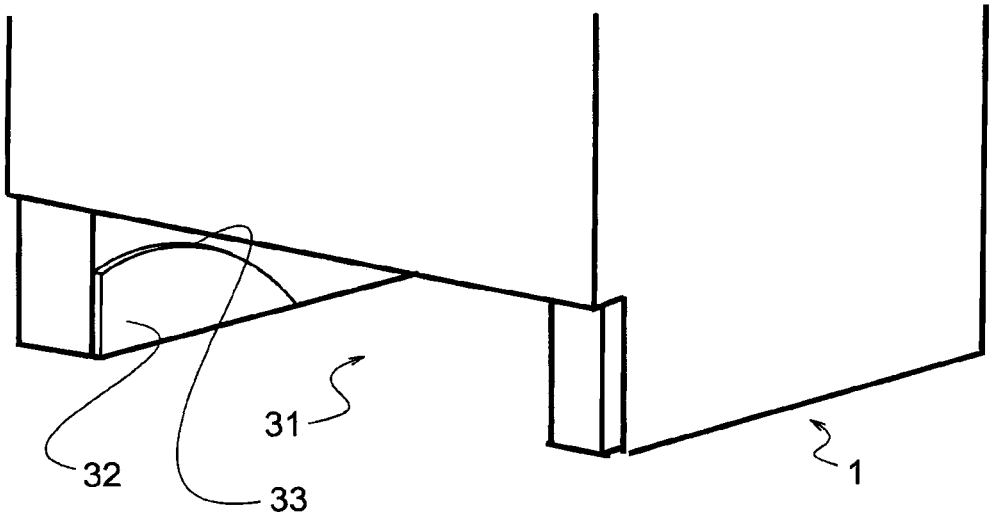
FIG. 8 illustrates a location at which a rail is provided.

FIG. 8 illustrates a location at which the rail is provided.

The printer 1 is provided with an arcuate rail 33 on a side surface 32 at a location of insertion 31 in the lower part of the body, into which the paper feed tray 40 is to be inserted. When the paper feed tray 40 is taken out of the printer 1, the projecting portion 422 of the link mechanism 42 is pushed by the rail 33 to be lifted up.

Figure 9:
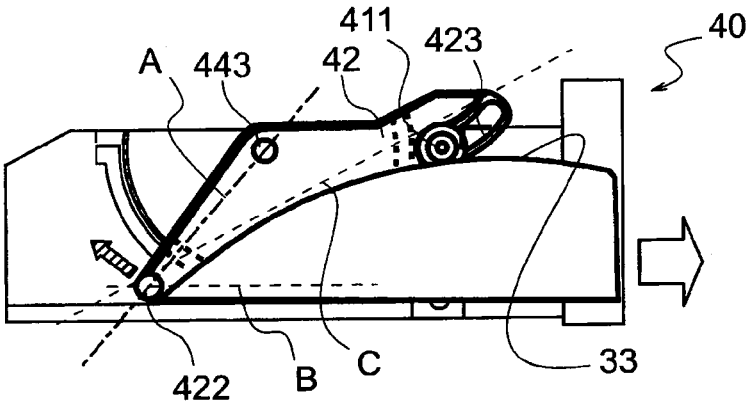
FIG. 9 illustrates a state in which the link mechanism has started moving.
Figure 10:
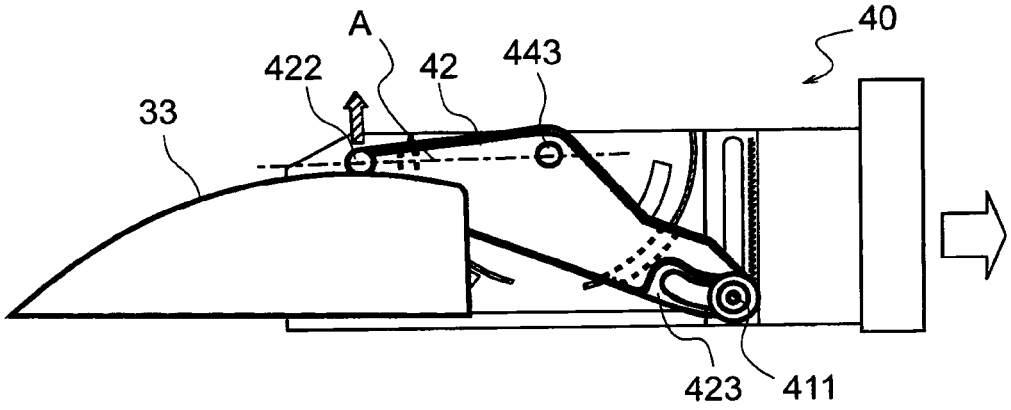
FIG. 10 illustrates a state in which the link mechanism has finished moving.

FIGS. 9 and 10 illustrate motion of the link mechanism 42 due to a force for drawing out the paper feed tray 40. FIG. 9 illustrates a state in which the link mechanism 42 has started moving. FIG. 10 illustrates a state in which the link mechanism 42 has finished moving.

The rail 33 is in an arcuate shape in which the rail 33 has a steep slope on the rear side and a gentle slope on the front side in the direction of drawing out the paper feed tray 40 (i.e. the right-left direction in the drawings). When the paper feed tray 40 is drawn out, the projecting portion 422 at the rear portion of the link mechanism 42 contacts the rail 33 to be moved along the rail 33. When the projecting portion 422 is pushed by the rail 33 to be lifted up, the link mechanism 42 is rotated about the rotary shaft 443, and the coupling portion 423 on the front side depresses the shaft 411.

The projecting portion 422 is provided at the rear portion of the link mechanism 42, and thus the projecting portion 422 is located away from the shaft 411 by a distance corresponding to the size of the link mechanism 42. Therefore, the distance over which the projecting portion 422 is moved along the rail 33 when the paper feed tray 40 is drawn out is longer than the distance over which the shaft 411 is moved before coming out of the printer 1.

The weight of the paper feed tray 40 itself acts in the direction of depressing the link mechanism 42 via the rotary shaft 443. Therefore, the weight of the paper feed tray 40 contributes in the direction of lifting up the projecting portion 422 using a reaction force from the rail 33, which helps rotation of the link mechanism 42.

The angle of the slope of the rail 33 is close to the angle of a line A that connects between the rotary shaft 443 and the projecting portion 422 irrespective of the position of the paper feed tray 40. Thus, the direction in which the slope of the rail 33 pushes the projecting portion 422 is close to the perpendicular to the line A. In order for the arcuate rail 33 to contact the projecting portion 422 with such an angle, it is required that the rotary shaft 443 should be positioned above a line B that indicates the lowermost point of the projecting portion 422.

As illustrated in FIG. 9, when the paper feed tray 40 starts being drawn out, the projecting portion 422 of the link mechanism 42 contacts a location on the steep slope positioned at the rear portion of the rail 33. The angle of the slope of the rail 33 corresponds to the amount by which the projecting portion 422 is lifted up for the amount by which the paper feed tray 40 is drawn out. When the projecting portion 422 contacts a location of the steep slope, the projecting portion 422 is lifted up greatly for a small amount by which the paper feed tray 40 is drawn out. As a result, the link mechanism 42 is greatly rotated about the rotary shaft 443, and the coupling portion 423 on the front side greatly depresses the shaft 411.

When the shaft 411 starts being lowered, the force of the push spring 43 which lifts up the bottom plate 41 is weak, and thus it is desirable that the shaft 411 (and the bottom plate 41) should be depressed greatly as the paper feed tray 40 is drawn out by a small amount. In the present exemplary embodiment, the rotary shaft 443 is positioned above a line C that connects between the coupling portion 423 and the projecting portion 422. Therefore, when the paper feed tray 40 starts being drawn out, the rail 33 has a large angle at the location of contact with the projecting portion 422, which depresses the shaft 411 (and the bottom plate 41) greatly.

In the case where the coupling portion 423 depresses the shaft 411 to the vicinity of the lowermost point with the paper feed tray 40 drawn out as illustrated in FIG. 10, the push spring 43 pushes up the shaft 411 with a large force, and a force that counteracts the force of the push spring 43 is required. Therefore, the slope of the rail 33 is gentle on the front side, and a strong force is generated by moving the projecting portion 422 by a small amount for a large amount by which the paper feed tray 40 is drawn out.

The shaft 411 which has been depressed is locked by a lock mechanism (not illustrated), and the shaft 411 and the bottom plate 41 which have been depressed are held in position. This locking is released when the paper feed tray 40 is inserted into the printer 1 and reaches the position indicated in FIGS. 9 and 1, and the bottom plate 41 is lifted up by the push spring 43.

Next, a structure of attaching the link mechanism 42 to the side wall 44 of the paper feed tray 40 will be described.

Figure 11:
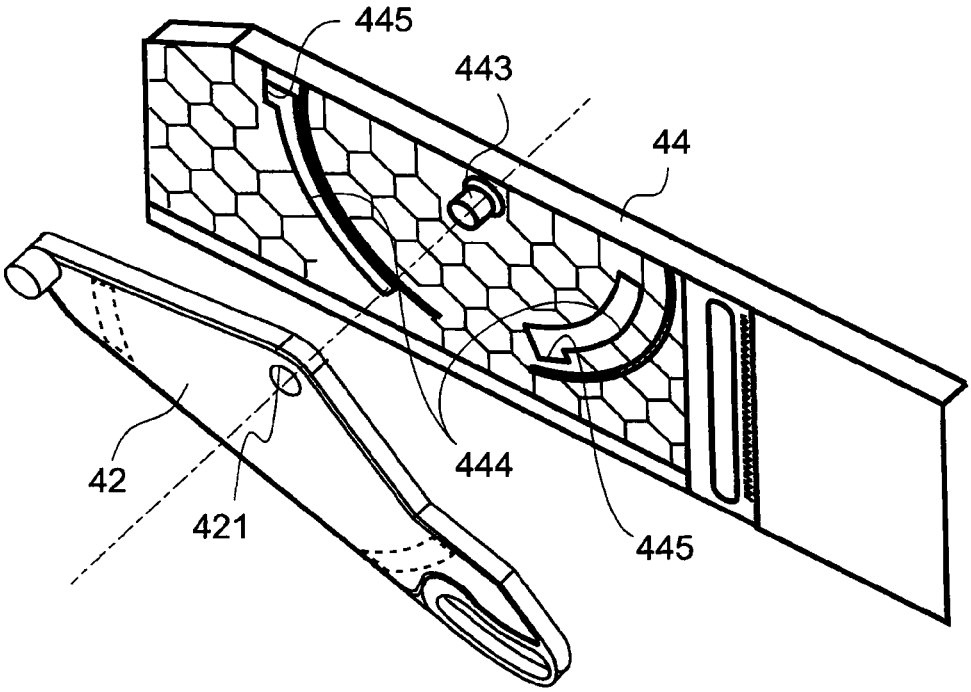
FIG. 11 is a perspective view of an attachment structure for the link mechanism as seen from the link mechanism side toward the side wall side.
Figure 12:
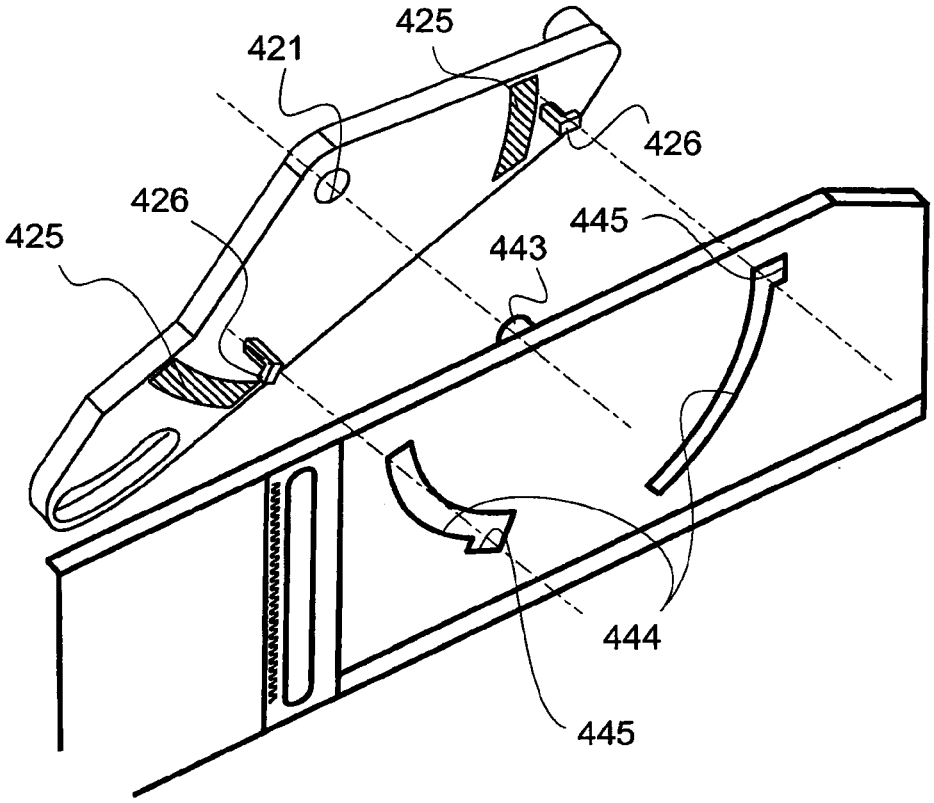
FIG. 12 is a perspective view of the attachment structure for the link mechanism as seen from the side wall side toward the link mechanism side.

FIGS. 11 and 12 illustrate an attachment structure for the link mechanism 42. FIG. 11 is a perspective view as seen from the link mechanism 42 side toward the side wall 44 side. FIG. 12 is a perspective view as seen from the side wall 44 side toward the link mechanism 42 side. In the following description, the side illustrated in FIG. 11 is occasionally referred to as the "front side", and the side illustrated in FIG. 12 is occasionally referred to as the "back side".

As discussed above, the link mechanism 42 is held on the side wall 44 via the rotary shaft 443. The back side (side facing the side wall 44) of the link mechanism 42 is formed with the planar portions 425 discussed above, and provided with two lugs 426 that project toward the side wall 44. On the other hand, the side wall 44 is provided with arcuate slits 444 centered on the rotary shaft 443 so that the tips of the lugs 426 are engaged with the edges of the slits 444. In addition, the round hole 421 is displaced from a line (not illustrated) that connects between the two lugs 426. Thus, the two lugs 426 and the round hole 421 form a triangle. Further, the tips of the lugs 426 are directed away from the rotary shaft 443, and therefore the lugs 426 are engaged with the outer edges of the slits 444.

When the link mechanism 42 is attached to the side wall 44, the rotary shaft 443 passes through the round hole 421 of the link mechanism 42, and the two lugs 426 pass through notched portions 445 of the slits 444. The two lugs 426 pass through the notched portions 445 in the case where the link mechanism 42 is in a specific direction about the rotary shaft 443. When the tips of the lugs 426 pass through the notched portions 445, the lugs 426 are engaged with the edges of the slits 444 to enable rotation of the link mechanism 42. The lugs 426 function as rotation stoppers for the link mechanism 42 in the course of the tips of the lugs 426 passing through the notched portions 445. The lugs 426 also serve as an example of a holding portion in the present disclosure.

A procedure by which the link mechanism 42 with such a structure is attached to the side wall 44 will be described below.

Figure 13:
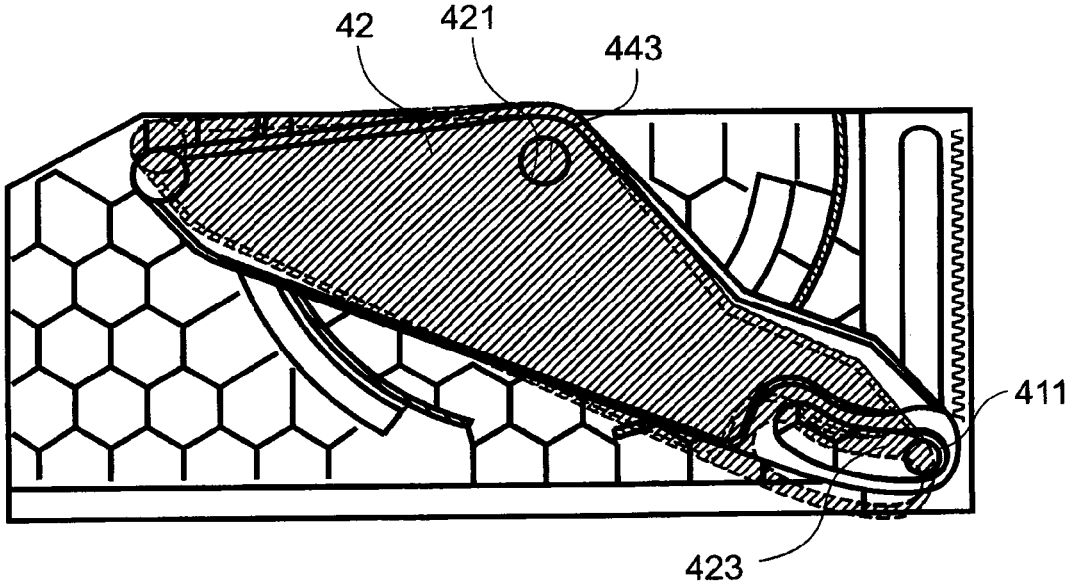
FIG. 13 illustrates a first stage of attachment of the link mechanism to the side wall.

FIG. 13 illustrates a first stage of attachment of the link mechanism 42 to the side wall 44.

In FIG. 13, the link mechanism 42 with the coupling portion 423 coupled to the shaft 411 is indicated by the solid line, and the link mechanism 42 with the round hole 421 and the lugs 426 discussed above fitted with the rotary shaft 443 and the notched portions 445 discussed above, respectively, to serve as rotation stoppers is indicated by the dotted line. At the first stage of attachment of the link mechanism 42 to the side wall 44, the link mechanism 42 is kept in the direction indicated by the dotted line with the rotation stoppers activated. In this direction, the shaft 411 is not insertable into the long hole 424 of the coupling portion 423 of the link mechanism 42 with the frame of the coupling portion 423 abutting against the shaft 411.

The positional relationship between the coupling portion 423 and the shaft 411 indicated by the solid line in FIG. 13 corresponds to an example of a first positional relationship in the present disclosure. The positional relationship between the coupling portion 423 and the shaft 411 indicated by the dotted line in FIG. 13 corresponds to an example of a second positional relationship in the present disclosure.

When the link mechanism 42 in a state indicated by the dotted line in FIG. 13 is pushed toward the side wall 44 by an assembling person, the link mechanism 42 is moved to a position at which the coupling portion 423 is coupled to the shaft 411.

A procedure by which the link mechanism 42 is pushed will be described below.

Figure 14:
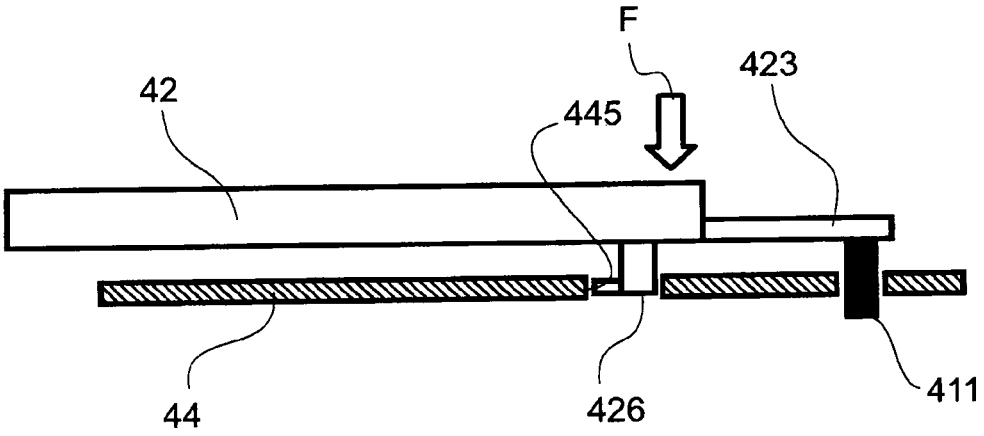
FIG. 14 is a side view schematically illustrating the link mechanism indicated by the dotted line in FIG. 13.

FIG. 14 is a side view schematically illustrating the link mechanism 42 indicated by the dotted line in FIG. 13.

Rotation stoppers for the link mechanism 42 are activated with the tips of the lugs 426 of the link mechanism 42 kept in the middle of the notched portions 445 of the side wall 44. In this state, the tips of the lugs 426 are not insertable deep into the notched portions 445 with the coupling portion 423 abutting against the shaft 411.

In this state, the link mechanism 42 is pushed as indicated by the arrow F in the drawing by the assembling person.

Figure 15:
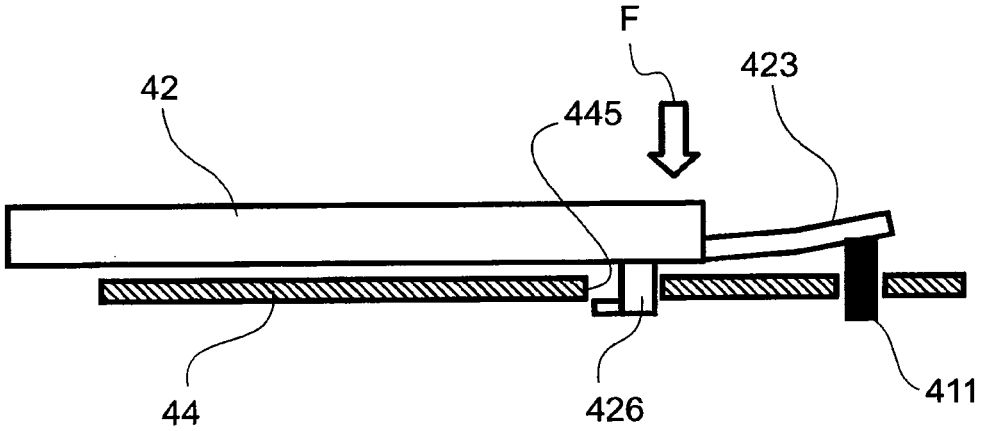
FIG. 15 illustrates a state in which the link mechanism is pushed from the state illustrated in FIG. 14.

FIG. 15 illustrates a state in which the link mechanism is pushed from the state illustrated in FIG. 14.

When the link mechanism 42 is pushed as indicated by the arrow F in the drawing, the coupling portion 423 is bent by a reaction force due to abutment with the shaft 411. The coupling portion 423 is formed to be thinner than a portion of the link mechanism 42 connected to the coupling portion 423, and thus is easily bendable by the reaction force. When the coupling portion 423 is bent, the tips of the lugs 426 are inserted deep into the notched portions 445. As a result, the rotation stoppers for the link mechanism 42 are deactivated.

Figure 16:
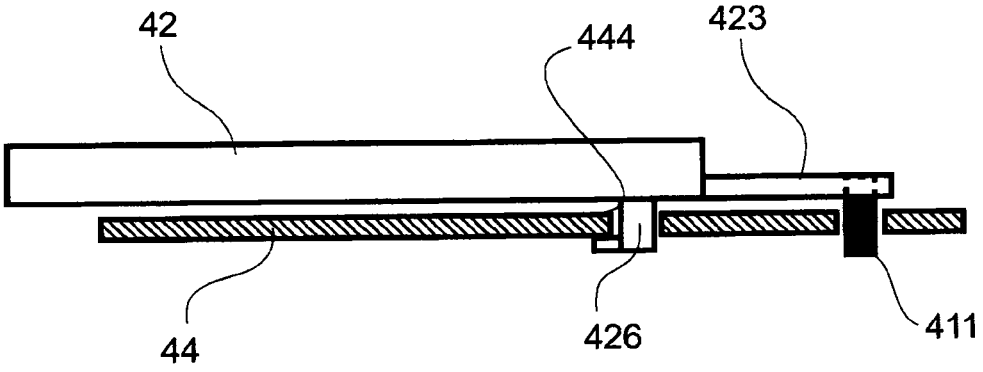
FIG. 16 illustrates a state in which rotation stoppers are released from the state illustrated in FIG. 15.

FIG. 16 illustrates a state in which the rotation stoppers are released from the state illustrated in FIG. 15.

When the link mechanism 42 is rotated with the rotation stoppers for the link mechanism 42 deactivated, the tips of the lugs 426 are engaged with the edges of the slits 444, which suppresses separation of the link mechanism 42 from the side wall 44. In addition, when the link mechanism 42 is rotated, the tip of the shaft 411 passes through the long hole of the coupling portion 423, which straightens the coupling portion 423 which has been bent. After that, the rotary member 415 which also serves as a slip-off stopper is attached to the distal end of the shaft 411.

The link mechanism 42 is easily attached to the side wall 44 through the procedure described above.

In the above description, an electrophotographic image engine is described as an example of an image forming portion according to the present disclosure. However, the image forming portion according to the present disclosure may be an image engine that forms an image using an inkjet system or the like.

In the above description, in addition, a monochrome printer is described as an image forming apparatus according to an exemplary embodiment of the present disclosure. However, the image forming apparatus according to the present disclosure may be a color printer, a copier, a facsimile, or a multi-function device.

The present disclosure has been made for the purpose of addressing the issue described in the "Summary" section. However, the configuration according to the present disclosure may also be used for other purposes that do not address the above issue, and aspects in which the configuration according to the present disclosure are used for such purposes are also exemplary embodiments of the present disclosure.

What is claimed is:

1. A medium supply apparatus comprising:

a box member inside which a medium is stored and which is inserted into and extracted from a body of an image forming apparatus;

a bottom plate which is disposed at a bottom portion of the box member and on which the medium is placed, the bottom plate being lifted up by an elastic force of an elastic member; and a rotary portion attached to a side wall, among walls of the box member, positioned on a lateral side with respect to a front side toward which the box member is extracted from the image forming apparatus, the rotary portion being rotatable about a location of attachment of the rotary portion, wherein the rotary portion includes a rear portion positioned on a rear side, in contrast to the front side, with respect to the location of attachment, the rear portion being moved upward by a reaction force applied from the body when the box member is extracted, and a front portion positioned on the front side with respect to the location of attachment, the front portion being moved downward by rotation of the rotary portion due to upward movement of the rear portion to lower the bottom plate against the elastic force, wherein the front portion has a contact surface that contacts a contact target that is at least one of a part of the bottom plate and a member that is movable in an up-down direction together with the bottom plate, a location of contact of the contact surface with the contact target is moved along with the rotation of the rotary portion, and the contact surface at the location of contact is directed in a direction of movement of the contact target.

2. The medium supply apparatus according to claim 1, wherein the location of attachment is positioned above the rear portion which has been moved to a lowermost point.

3. The medium supply apparatus according to claim 2, wherein the location of attachment is positioned above a line that connects between the rear portion and the front portion.

4. The medium supply apparatus according to claim 1, wherein the contact target is a rotary member that is rotatable about a shaft that is movable in the up-down direction together with the bottom plate.

5. The medium supply apparatus according to claim 1, wherein the side wall has an arcuate hole centered on the location of attachment, the rotary portion has at least two lugs that are engaged with an edge of the hole to suppress separation of the rotary portion from the side wall, and the location of attachment is displaced from a line that connects between the two lugs.

6. The medium supply apparatus according to claim 5, wherein the lugs are directed away from the location of attachment.

7. The medium supply apparatus according to claim 1, wherein one of the side wall and the rotary portion has a protrusion that projects toward the other of the side wall and the rotary portion, and the one of the side wall and the rotary portion contacts the other at the protrusion.

8. The medium supply apparatus according to claim 7, wherein the one is the side wall.

9. The medium supply apparatus according to claim 7, the protrusion is in an arcuate shape centered on the location of attachment.

10. The medium supply apparatus according to claim 1, wherein the rotary portion is attached to the side wall by first attaching the rotary portion to the side wall at the location of attachment, and thereafter rotating the rotary portion such that a relative positional relationship between the front portion and the bottom plate corresponds to a first positional relationship, the rotary portion includes a holding portion that holds the rotary portion in a direction in which the positional relationship between the front portion and the bottom plate corresponds to a second positional relationship that is different from the first positional relationship and the front portion contacts a member on a side of the bottom plate after attachment at the location of attachment, and the front portion is pushed toward the side wall in the second positional relationship to be deflected by a reaction force from the member on the side of the bottom plate, as a result of which holding by the holding portion is canceled and the positional relationship transitions to the first positional relationship.

11. The medium supply apparatus according to claim 10, wherein the side wall has an arcuate hole centered on the location of attachment, the rotary portion has at least two lugs that are engaged with an edge of the hole to suppress separation of the rotary portion from the side wall, the lugs also serving as the holding portion, and the location of attachment is displaced from a line that connects between the two lugs.

12. The medium supply apparatus according to claim 11, wherein the lugs pass through a notched portion provided at the edge of the hole to be engaged with the side wall when the rotary portion is attached to the side wall, and the lugs hinder rotation of the rotary portion in a course of passing through the notched portion to hold the positional relationship between the front portion and the bottom plate in the second positional relationship.

13. The medium supply apparatus according to claim 10, wherein the front portion is thinner than a portion of the rotary portion connected to the front portion.

14. An image forming apparatus comprising:

a medium supply apparatus including a box member inside which a medium is stored and which is inserted into and extracted from a body of the image forming apparatus, a bottom plate which is disposed at a bottom portion of the box member and on which the medium is placed, the bottom plate being lifted up by an elastic force of an elastic member, and a rotary portion attached to a side wall, among walls of the box member, positioned on a lateral side with respect to a front side toward which the box member is extracted from the image forming apparatus, the rotary portion being rotatable about a location of attachment of the rotary portion, wherein the rotary portion includes a rear portion positioned on a rear side, in contrast to the front side, with respect to the location of attachment, the rear portion being moved upward by a reaction force applied from the body when the box member is extracted, and a front portion positioned on the front side with respect to the location of attachment, the front portion being moved downward by rotation of the rotary portion due to upward movement of the rear portion to lower the bottom plate against the elastic force, wherein the front portion has a contact surface that contacts a contact target that is at least one of a part of the bottom plate and a member that is movable in an up-down direction together with the bottom plate, a location of contact of the contact surface with the contact target is moved along with the rotation of the rotary portion, and the contact surface at the location of contact is directed in a direction of movement of the contact target; and an image forming portion that forms an image on the medium which is supplied from the medium supply apparatus.

* * * * *